US010286621B2

(12) United States Patent
Toro

(10) Patent No.: US 10,286,621 B2
(45) Date of Patent: May 14, 2019

(54) MACHINE AND METHOD FOR MAKING BLANKS FOR BOXES TO MEASURE

(71) Applicant: SYSTEM S.P.A., Fiorano Modenese (Modena) (IT)

(72) Inventor: Andrea Toro, Fiorano Modenese (IT)

(73) Assignee: SYSTEM S.P.A., Fiorano Modenese (IT)

( * ) Notice: Subject to any disclaimer, the term of this patent is extended or adjusted under 35 U.S.C. 154(b) by 237 days.

(21) Appl. No.: 15/305,957

(22) PCT Filed: May 13, 2015

(86) PCT No.: PCT/IB2015/053520
§ 371 (c)(1),
(2) Date: Oct. 21, 2016

(87) PCT Pub. No.: WO2015/173744
PCT Pub. Date: Nov. 19, 2015

(65) Prior Publication Data

US 2017/0057190 A1 Mar. 2, 2017

(30) Foreign Application Priority Data

May 16, 2014 (IT) ..... MO2014A0135

(51) Int. Cl.
*B31B 50/62* (2017.01)
*B31B 50/00* (2017.01)
(Continued)

(52) U.S. Cl.
CPC ..... *B31B 50/62* (2017.08); *B31B 50/00* (2017.08); *B31B 50/10* (2017.08); *B31B 50/146* (2017.08);
(Continued)

(58) Field of Classification Search
CPC ..... B31B 50/62; B31B 50/00; B31B 50/16; B31B 50/18; B31B 50/20; B31B 2100/00; B31B 2100/35; B31B 50/146; B31B 50/10
See application file for complete search history.

(56) References Cited

U.S. PATENT DOCUMENTS 9,962,895 B2 * 5/2018 Ponti ..... B65D 5/2095
2004/0214704 A1 10/2004 Gardner et al.
(Continued)

FOREIGN PATENT DOCUMENTS

SU 992220 1/1983
SU 1121156 10/1984
(Continued)

*Primary Examiner* — Omar Flores Sanchez
(74) *Attorney, Agent, or Firm* — Pearne & Gordon LLP

(57) ABSTRACT

A machine (1) for making blanks (2) for boxes to measure, comprises feed means configured for realizing rectangular pieces (3) of the blank (2). Each rectangular piece (3) has a width ("La"), measured along a first edge (3*a*) thereof, which width ("La") is equal to a pre-determined width ("La") of the blank (2) and a length ("Lu"), measured along a second edge (3*b*) of said rectangular piece, said length ("Lu") being preferably less than a pre-determined length ("Lu") of the blank (2). Joining means (32) are configured for joining at least two rectangular pieces (3) or one rectangular piece (3) and a piece of an intermediate blank previously made, relative to respective first edges (3*a*), so as to obtain a blank exhibiting an intermediate width ("La"), which intermediate width ("La") is equal to the pre-determined width ("La") of the blank (2), and a length which is greater than the pre-determined length ("Lu") of the blank (2). Cutting means (40) are configured for cutting the intermediate blank parallel to the first edges in order to obtain the blank (2).

16 Claims, 9 Drawing Sheets

(51) Int. Cl.

| | |
|---|---|
| *B31B 50/10* | (2017.01) |
| *B31B 50/16* | (2017.01) |
| *B31B 50/18* | (2017.01) |
| *B31B 50/20* | (2017.01) |
| *B31B 100/00* | (2017.01) |
| *B31B 50/14* | (2017.01) |
| *B31B 110/35* | (2017.01) |

(52) U.S. Cl.
CPC ..... *B31B 50/16* (2017.08); *B31B 50/18* (2017.08); *B31B 50/20* (2017.08); *B31B 50/624* (2017.08); *B31B 2100/00* (2017.08); *B31B 2110/35* (2017.08)

(56) References Cited

U.S. PATENT DOCUMENTS

| | | | | |
|---|---|---|---|---|
| 2013/0225383 | A1 | 8/2013 | Toro | |
| 2017/0361560 | A1* | 12/2017 | Osterhout | B31B 50/07 |
| 2018/0162083 | A1* | 6/2018 | Capoia | B65B 59/00 |

FOREIGN PATENT DOCUMENTS

| | | | |
|---|---|---|---|
| WO | 2012/063152 | A1 | 5/2012 |
| WO | 2013/128359 | A1 | 9/2013 |

* cited by examiner

MACHINE AND METHOD FOR MAKING BLANKS FOR BOXES TO MEASURE

The invention relates to a machine and a method for making blanks for boxes to measure.

In machines and methods of the known type, boxes can be obtained from a continuous sheet or single sheets, particularly cardboard sheets. In order to change the size of the box to be realized, it is required to change the size of the continuous sheet or single sheets as well. Particularly, the continuous sheet or single sheets exhibiting the necessary width, (transverse dimension), must be selected so that the box can be realized.

In the known art, upstream of the machine for making blanks, there is therefore provided an automatic store for continuous and/or single sheets having different sizes, as well as suitable conveying means moving towards and from the machine, and at least one operator assigned to changing the size of the sheets.

When using continuous sheets, the width of the blank and the width of the final box is defined by the width of the continuous sheet (transverse dimension). The length of the blank is obtained by cutting the continuous sheet perpendicularly to its length which corresponds to the major direction of extension of said continuous sheet.

Where the sizes of the box, particularly the width thereof, do not exactly correspond to the sizes of the continuous sheet, cuts are to be performed which produce waste.

In this context, the technical task at the base of the present invention is to provide a machine and method for making blanks for boxes to measure which obviate the drawbacks of the known art mentioned above.

In particular, it is an object of the present invention to provide a machine and method for making blanks for boxes to measure suitable for removing production waste.

A further object of the present invention is to provide a machine and method for making blanks for boxes to measure able to limit the stocks inside the automatic store by limiting the size number of continuous sheets and single sheets.

The technical task mentioned and the aims specified are substantially attained by a machine and method for making blanks for boxes to measure, comprising the technical characteristics mentioned in one or more of the appended claims. The dependent claims correspond to different embodiments of the invention.

According to a first aspect, the present invention relates to a method for making blanks for boxes to measure. This method provides to realize rectangular pieces of the blank. Each rectangular piece has a width measured along a first edge thereof, which width is equal to a pre-determined width of the blank, and a length measured along a second edge of the rectangular piece, said length being preferably less than a pre-determined length of the blank. It is further provided to make at least one intermediate blank obtained from the rectangular pieces, which intermediate blank exhibits a width equal to the pre-determined width of the blank and a length greater than the length of the rectangular pieces and the pre-determined length of the blank. Making at least one intermediate blank comprises joining, at respective first edges, a rectangular piece to another rectangular piece or a rectangular piece to a piece of an intermediate blank previously made. It is further provided to cut the intermediate blank parallel to the first edges so as to obtain the blank having a pre-determined width and a pre-determined length.

In accordance with a further aspect, the present invention relates to a machine for making blanks for boxes to measure, comprising feed means configured for making rectangular pieces of the blank, wherein each rectangular piece has a width measured along a first edge of the former, which width is equal to a pre-determined width of the blank, and a length measured along a second edge of the rectangular piece itself, which length is less than a pre-determined length of the blank. There are also provided joining means for joining at least two rectangular pieces at respective first edges, so as to obtain an intermediate blank having a width equal to the pre-determined width of the blank and a length greater than the pre-determined length of the blank. Finally, there are provided cutting means to cut the intermediate blank parallel to the first edges, in order to obtain a blank exhibiting a pre-determined width and a pre-determined length.

The present invention may provide one or more of the features as below detailed, in relation to one or more of the aspects described hereinabove.

According to a possible embodiment, the step of making rectangular pieces of the blank comprises providing a continuous sheet that extends along a major direction of extension and exhibits a transverse dimension.

The continuous sheet is fed along its major direction of extension and cut perpendicularly with respect to the major direction of extension, along a length equal to the pre-determined width of the blank.

In order to obtain rectangular pieces of the blank, the feed means preferably comprises an automatic store configured for receiving a continuous sheet which extends along a major direction of extension and exhibits a transverse dimension. A feed path is configured for planar feeding of continuous sheet along the major direction of extension corresponding to a first feed direction.

Preferably there are provided preliminary cutting means configured for cutting the continuous sheet perpendicularly to the major direction of extension along a length which is equal to the pre-determined width of the blank.

Preferably, the preliminary cutting means comprises at least one cutter which is movable perpendicularly to the first feed direction along a slit of a supporting surface of the continuous sheet and co-operates with a matrix arranged on the opposite side of the supporting surface.

In accordance with a possible embodiment, the step of realizing rectangular pieces of the blank further comprises trimming the continuous sheet along the major direction of extension so as to obtain a thickness which is inclined relative to a plane in which the continuous sheet lies.

Preferably there is provided a trimming device configured for trimming the continuous sheet along the first feed direction, so as to obtain a thickness inclined relative to a plane in which the continuous sheet lies.

According to a possible embodiment, the step of realizing rectangular pieces of the blank comprises providing at least one single sheet having an initial width measured along a first edge of the single sheet, and an initial length measured along a second edge of the single sheet. In order to obtain the pre-determined width of the blank, if the initial width is different from the pre-determined width of said blank, it is further provided to obtain rectangular pieces from single sheets by cutting a single sheet perpendicularly to the initial width and/or by joining, at respective second edges, a single sheet to another sheet or to single sheet pieces.

Preferably the feed means for obtaining rectangular pieces of the blank comprises an automatic store for single sheets, each having an initial width measured along a first edge of the single sheet, and an initial length, measured along a second edge of the single sheet. A feed path is configured for planar feeding of single sheets along a first feed direction which is parallel to the initial width.

Preferably preliminary cutting means are provided configured for cutting the single sheet perpendicularly to the initial width.

Preferably, the preliminary cutting means comprises at least one cutter which is movable perpendicularly to the first feed direction, along a slit of a supporting plane of the single sheets and co-operating with a matrix arranged on the opposite side of the supporting surface.

Preferably there are provided preliminary joining means configured for joining the single sheet to another single sheet, or to pieces of single sheets at respective second edges, thereby obtaining the pre-determined width of the blank, if the initial width is different from the pre-determined width of the blank.

According to a possible embodiment, the step of obtaining rectangular pieces of the blank further comprises trimming the single sheet along the initial width, thus obtaining an thickness which is inclined relative to a plane in which the single sheet lies.

Preferably there is provided a trimming device configured for trimming the single sheet along the first feed direction in order to obtain a thickness inclined relative to a plane in which the single sheet lies.

According to a possible embodiment, there is provided to realize the rectangular pieces of the blank, by conveying one continuous sheet or single sheets along a first feed direction. It is further provided to obtain the intermediate blank and to cut said intermediate blank by conveying the rectangular pieces and the intermediate blank along a second feed direction which is perpendicular to the first feed direction.

Preferably there is provided a forming path configured for planar feeding of rectangular pieces along a second feed direction, perpendicular to the first feed direction. The joining means and the cutting means are arranged along the forming path.

Further characteristics and advantages of the present invention will become more apparent from the indicative, and therefore non-limiting, description of a preferred but not exclusive embodiment of a machine for making blanks for boxes to measure, as illustrated in the accompanying drawings in which:

FIG. 1 is a schematic view in perspective of a machine for making blanks for boxes to measure according to the present invention;

FIG. 1*a* is a schematic view of the machine of FIG. 1, in which an automatic store for sheets feeding is realized according to an alternative embodiment;

Figure 1:
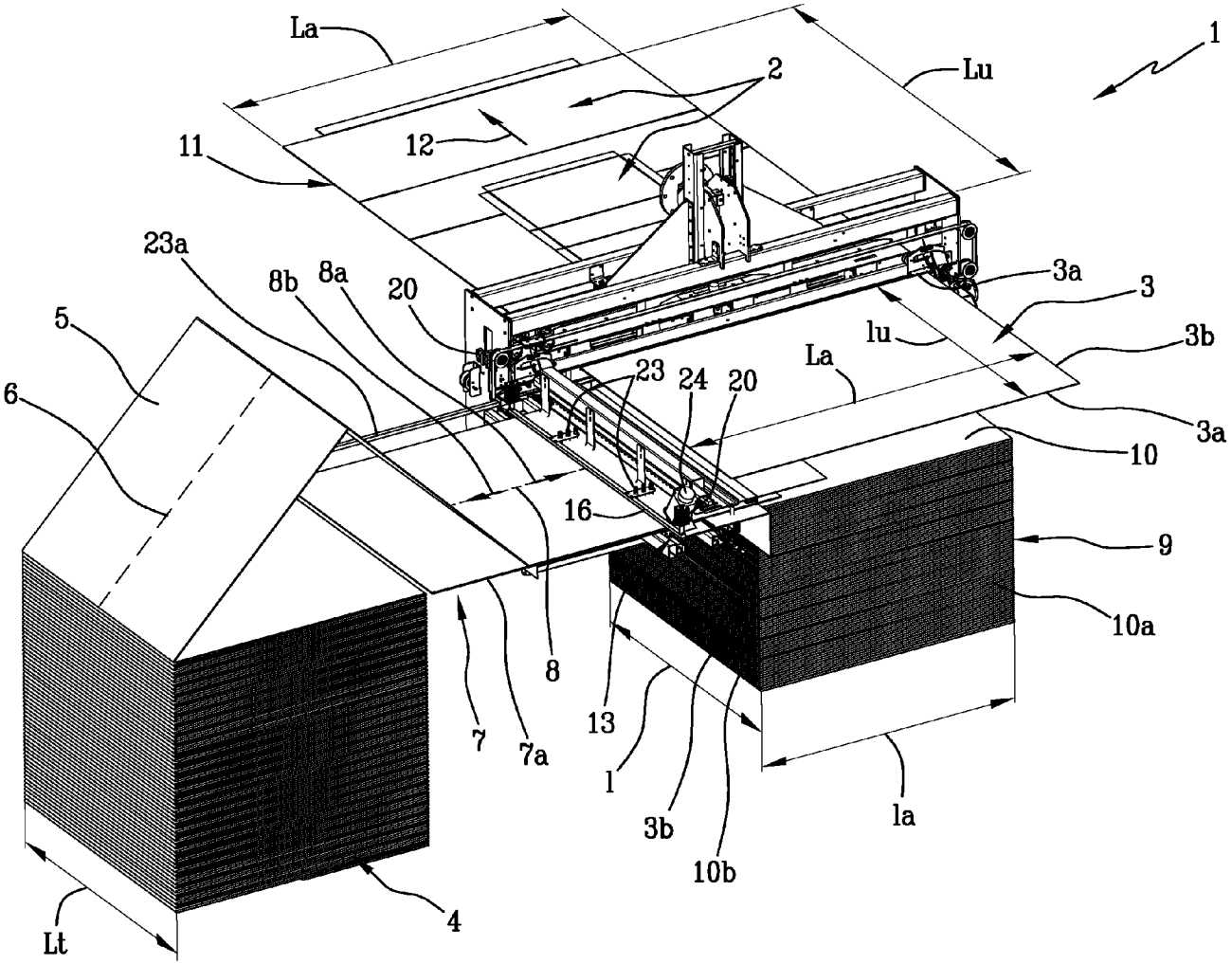

With reference to the attached figures, with 1 it is indicated a machine for making blanks 2 for boxes to measure in its entirety, hereinafter also referred to as machine 1. In FIG. 1 there were indicated two different blanks having different sizes for making two boxes with different sizes.

The machine 1 comprises feed means configured for realizing rectangular pieces 3 of the blank 2.

Each rectangular piece 3 exhibits a width "La", measured along a first edge 3*a* of the former, which width "La" is equal to a pre-determined width "La" of the blank 2.

Each rectangular piece 3 further exhibits a length "Lu" measured along a second edge 3*b* of said rectangular piece, said length "Lu" being preferably less than a pre-determined length "Lu" of the blank 2.

According to a possible embodiment, the feed means comprises an automatic store 4, configured for receiving a continuous sheet 5 extending along a major direction of extension 6 and having a transverse dimension "Lt". A feed path 7 is configured for planar feeding of continuous sheet 5 along the major direction of extension 6 corresponding to a first feed direction 8.

Figure 1A:
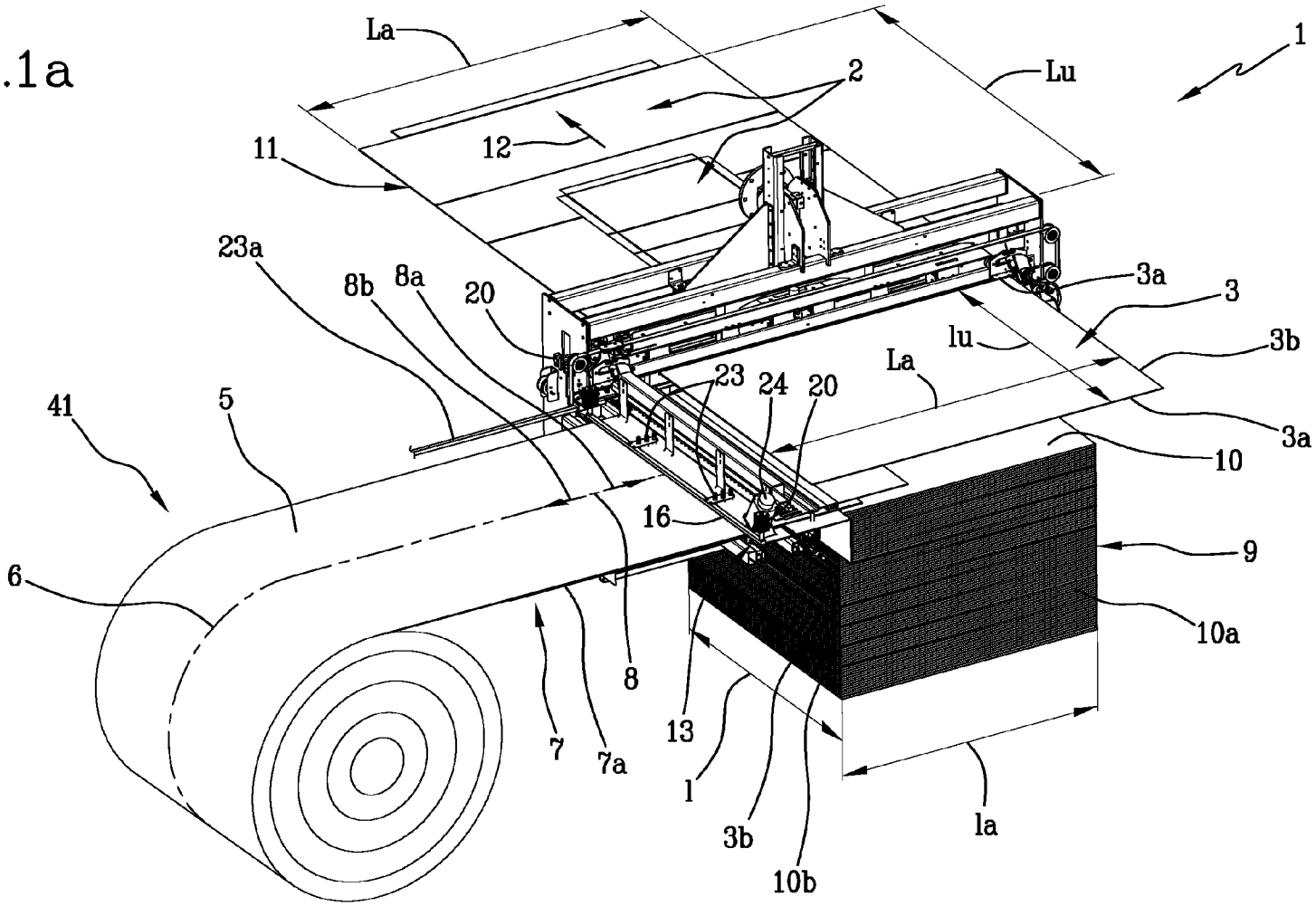
Figure 2:
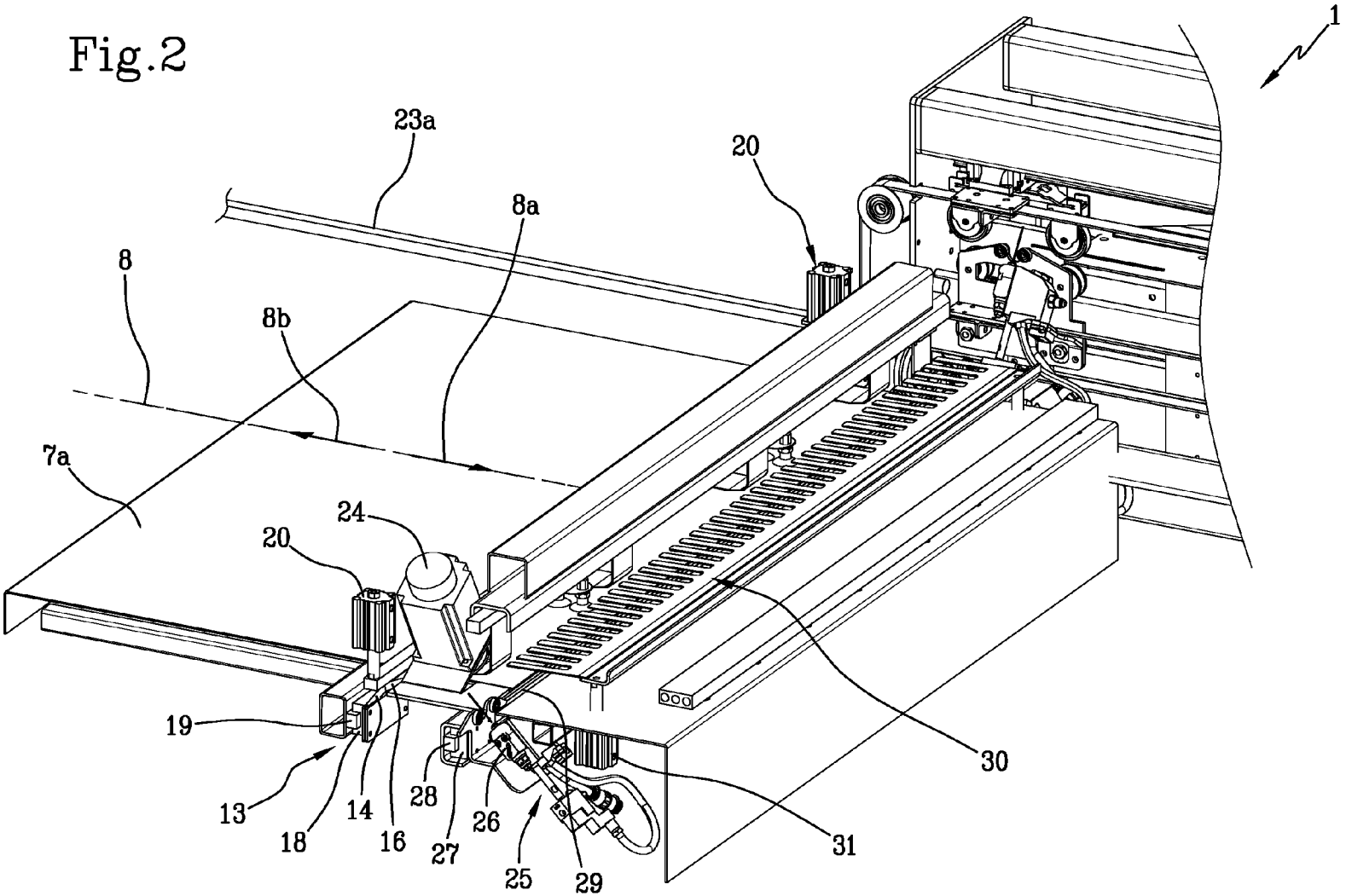
FIG. 2 is a schematic perspective view of an enlarged detail of the machine of FIG. 1, according to a different angle, in which some elements have been omitted to highlight others.

In a further embodiment, illustrated in FIG. 1*a*, the feed means comprises an automatic store 41 configured for receiving a continuous sheet 5 wound in a roll along the major direction of extension 6.

According to a possible embodiment, the feed means comprises an automatic store 9 of single sheets 10.

Each single sheet has an initial width "La", measured along a first edge 10*a* of the single sheet, and an initial length "l", measured along a second edge 10*b* of the single sheet.

A feed path 7 is configured for planar feeding of single sheets 10 along a first feed direction 8 which is parallel to the initial width "La".

In one embodiment of the machine 1, illustrated by way of example in the appended figures, there can be provided both the automatic store 4 and the automatic store 9. In other words, the machine 1 can be fed selectively either with a continuous sheet 5 or with single sheets 10. In this case the continuous sheet 5 and the single sheets 10 are fed along the same feed path 7 and along the same first feed direction 8.

Preferably, at least a portion of the feed path 7 comprises a supporting surface 7*a* adapted to receive the continuous sheet 5 and/or the single sheets 10 arranged planar. Particularly the supporting surface 7*a* is arranged horizontally in the use configuration of the machine 1.

According to a possible embodiment, the machine 1 comprises a forming path 11 configured for planar feeding of the rectangular pieces 3 along a second feed direction 12.

Preferably, the second feed direction 12 is perpendicular to the first feed direction 8 as illustrated by way of example in the appended figures.

According to a possible embodiment, the feed means comprises preliminary cutting means 13. Preferably, the preliminary cutting means 13 are arranged along the first feed direction 8.

Where it is provided to start from a continuous sheet 5, the preliminary cutting means 13 are configured for cutting the continuous sheet 5 perpendicularly to its major direction of extension 6, i.e., to the first feed direction 8, along a length which is equal to the pre-determined width "La" of the blank 2.

On the other hand, where it is provided to start from a single sheet 10, the preliminary cutting means 13 are configured for cutting the single sheet 10 perpendicularly to the initial width "La".

Advantageously the preliminary cutting means can be configured for cutting both the continuous sheet 5 and the single sheets 10.

Figure 4:
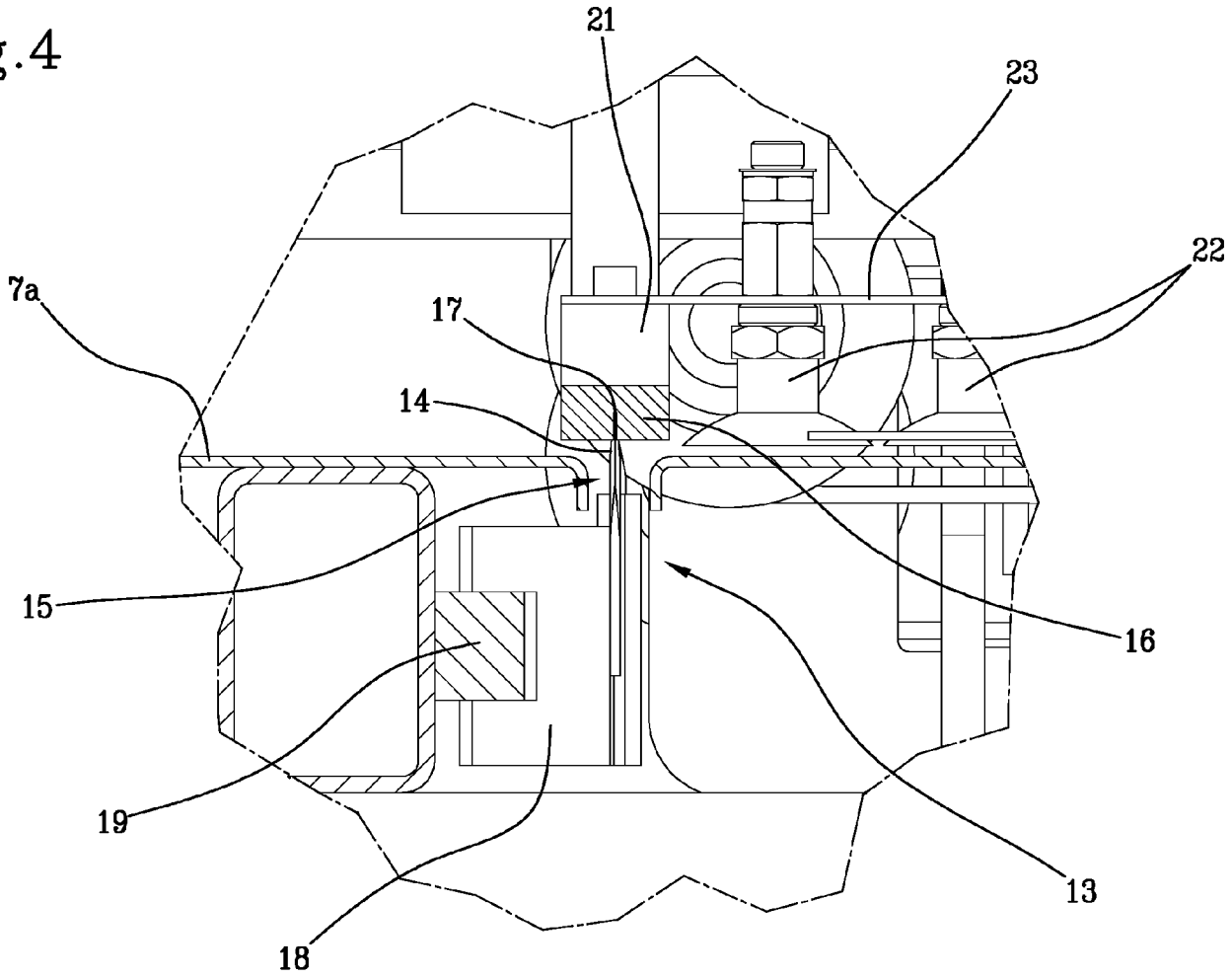
FIG. 4 is a schematic view in perspective of an enlarged detail of the machine of FIG. 1, wherein some elements have been omitted to highlight others.

In a possible embodiment, the preliminary cutting means 13 comprises at least one cutter 14 movable perpendicularly to the first feed direction 8 along a slit 15 of the supporting surface 7*a*. Preferably, the cutter 14 co-operates with a matrix 16 disposed on the opposite side of the supporting surface 7*a*. For this purpose the matrix 16 may exhibit a groove 17 (FIG. 4) inside which at least one portion of the cutter 14 can slide. In the non-limiting example illustrated in the figures, the cutter 14 is associated to a sliding block 18 slidable on a guide 19 positioned inferiorly to the supporting plane 7*a*. The matrix 16 is arranged above the supporting plane 7*a*.

According to a possible embodiment, actuators 20, for example linear actuators, may be associated to the matrix 16 so as to raise it and lower it relative to the supporting plane 7*a* and the cutter 14. Preferably a bar 21 arranged perpendicularly to the first feed direction 8 and movable between a raised position and a lowered position, is associated to the matrix 16.

Pressing elements 22 are movable between a raised position and a lowered position for pressing the continuous sheet or the single sheet on the supporting surface 7*a*. Preferably, the pressing elements 22 are solidly constraint to the bar 21 and to the matrix 16, for example by means of plates 23 arranged transversely to the bar 21. The preliminary cutting means 13, together with a portion of the supporting surface 7*a* and the matrix 16, are preferably slidable along the first feed direction 8 for example along guides 23*a*.

According to a possible embodiment, of which the appended drawings form a non-limiting example, the machine 1 can comprise at least a trimming device 24 configured for trimming the continuous sheet and/or the single sheet along the first feed direction 8 so as to obtain a thickness inclined relative to a plane in which the continuous sheet and/or the single sheet lie. Particularly the laying plane is defined by the supporting surface 7*a*.

The trimming device 24 is arranged so as to trim one of the first edges 3*a* of the continuous sheet 5 or one of the first edges 10*a* of the single sheet 10. If necessary, there can be provided two trimming devices 24 disposed on opposite sides of the supporting surface 7*a*. Each trimming device 24 is suitable for trimming a first edge 3*a* of the continuous sheet 5 or a first edge 10*a* of the single sheet.

The trimming device/s 24 is/are arranged and operate along the first feed direction 8.

In accordance with a possible embodiment, particularly where feeding process starts from the single sheets, it is useful to provide preliminary joining means 25 configured for joining, at respective second edges 10*b*, a single sheet to another single sheet or to pieces of single sheets so as to obtain the pre-determined width "La" of the blank 2, particularly if the initial width "La" is different from the pre-determined width "La" of the blank 2.

According to a possible embodiment, the preliminary joining means comprises a gun 26 suitable for providing a layer of adhesive material or glue at the second edges 10*b* of a single sheet or of a piece of a single sheet. Preferably the gun 26 is mounted slidably along a direction perpendicular to the first feed direction 8. In particular, the gun 26 comprises a sliding block 27 slidable on a guide 28 arranged perpendicularly to the first feed direction 8.

The preliminary joining means 25 are preferably arranged on the opposite side of the supporting surface 7*a* relative to the single sheet, and are adapted to operate relative to an interruption 29 of said supporting surface 7*a*.

According to a possible embodiment, the preliminary joining means 25 are arranged and operate along the first feed direction 8.

With the numeral 30 it is indicated a comb-shaped supporting element which is movable, for example, between a raised position and a lowered position by means of linear actuators 31 thereby keeping the ends of the trimmed edges in contact with one another, thus facilitating bonding thereof.

In use, it is now described how the feed means realize the rectangular pieces 3 of the blank 2 starting from the continuous sheet 5.

In particular it is provided to predispose a continuous sheet 5 which develops along the major direction of extension 6 and exhibits a transversal dimension "Lt", which is perpendicular to the major direction of extension 6. Preferably, said continuous sheet 5 is predisposed for starting from an automatic store 4 associated to the machine 1. The transversal dimension "Lt" can be equal to or greater than the length "Lu" of the rectangular piece 3 that will be obtained from the continuous sheet 5.

In particular there is provided to feed the continuous sheet 5 along the major direction of extension 6, i.e. along the first feed direction 8, along the feed path 7. According to a possible embodiment illustrated by way of example in the appended figures, the continuous sheet 5 is always fed along the same first feed direction 8*a*.

Along the feed path 7, the continuous sheet 5 is cut by means of preliminary cutting means 13 perpendicularly to its major direction of extension 6, and then perpendicularly to the first feed direction 8, along a length which is equal to the pre-determined width "La" of the blank 2.

According to a possible embodiment, along the feed path 7, the continuous sheet 5 can be trimmed along the major direction of extension 6, i.e. along the first feed direction 8. In this case the transversal dimension "Lt" of the continuous sheet 5 is greater than the length "Lu" of the rectangular piece 3. Following the trimming, a thickness is obtained, which is inclined with respect to a plane in which the continuous sheet lies. In other words it is possible to trim the continuous sheet so as to obtain a thickness which is inclined relative to one or both the first edges 3*a* of the rectangular piece 3.

At the end of the feed path 7, a rectangular piece is then obtained having a "La" width measured along a first edge 3*a*, equal to the pre-determined width "La" of the blank 2 and to the length "Lu", measured along a second edge 3*b*, said length "Lu" being preferably less than a pre-determined length "Lu" of the blank 2.

In use, it is now described how the feed means realizes rectangular pieces 3 of the blank 2 starting from single sheets 10.

In particular it is provided to predispose at least one single sheet 10 exhibiting an initial width "La", measured along a first edge 10*a* of the single sheet, and an initial length "l", measured along a second edge 10*b* of the single sheet. Preferably such single sheet 10 is arranged for starting from an automatic store 9 associated to the machine 1. The initial width "La" can be equal to or different, preferably greater, than the pre-determined width "La" of the blank 2, and thus of the rectangular piece 3. The initial length "L" is preferably less than a pre-determined length "Lu" of the blank 2 and can be greater than the length "Lu" of the rectangular piece 3.

In order to obtain the pre-determined width "La" of the blank 2, there is subsequently provided to attain rectangular pieces 3 by cutting a single sheet perpendicularly to the initial width "La" and/or by joining, at respective second edges 10*b*, a single sheet to another single sheet or to rectangular pieces of single sheets. Cutting and/or joining are performed particularly if the initial width "La" differs from the pre-determined width "La" of the blank 2.

In particular there is provided to feed the single sheet 10 along the first feed direction 8 and along the feed path 7. According to a possible embodiment, illustrated by way of example in the appended figures, the single sheet 10 can also be fed according to opposite feed directions.

For example a single sheet 10 can be picked up from the automatic store 9 and first fed along a direction 8*b* opposite to the feed direction 8*a*, and subsequently along the feed direction 8*a*. During this step, a cut is made perpendicularly to the initial width "La" and/or a joining is performed perpendicularly to the initial width "La" (relative to the second edges 10*b*), and/or a trimming is carried out along one or both the first edges 10*a*, so as to obtain an inclined thickness. The three above operations can be performed according to various timelines.

Along the feed path 7, the single sheet 10 can be cut by means of preliminary cutting means 13, perpendicularly to its initial width "La" so as to obtain a length equal to the pre-determined width "La" of the blank 2.

The cut made by the preliminary cutting means 13 is particularly performed where the initial length "La" is greater than the pre-determined width "La".

According to a possible embodiment, along the feed path 7, the single sheet 10 may be trimmed along the first feed direction 8. In this case the initial length "l" of the single sheet 10 is greater than the length "Lu" of the rectangular piece 3. Following the trimming, there is obtained a thickness inclined relative to a plane in which the single sheet lies. In other words it is possible to trim the single sheet in order to obtain a thickness inclined relative to one or both the first edges 3*a* of the rectangular piece 3.

Along the feed path 7, a single sheet 10 can be possibly joined, via preliminary joining means 25, along second edges 10*b*, to another single sheet or to pieces of single sheets, obtained for example as a result of cuts previously made through the preliminary cutting means 13. The cut obtained via the preliminary cutting means 13 can be performed prior or after the joining to another single sheet or to pieces of single sheets, said joining being obtained through the preliminary joining means 25.

At the end of the feed path 7, a rectangular piece is then obtained having a width "La" measured along a first edge 3*a*, said width "La" being equal to the pre-determined width "La" of the blank 2 and a length "Lu", measured along a second edge 3*b*, said length "Lu" being preferably less than a pre-determined length "Lu" of the blank 2.

In general it is therefore provided to realize rectangular pieces 3 by conveying a continuous sheet 5 or single sheets 10 along the first feed direction 8, and in particular along the feed path 7.

Following the feed path 7, the machine 1 exhibits the forming path 11.

Along the forming path 11 there is provided to realize at least one intermediate blank obtained by the rectangular pieces 3, which intermediate blank has a width "La" equal to the pre-determined width of the blank 2 and a length greater than the length "Lu" of the rectangular pieces 3 and the pre-determined length "Lu" of the blank 2.

In order to realize an intermediate blank, there is provided to join, relative to respective first edges 3*a*, a rectangular piece 3 to another rectangular piece 3 or a rectangular piece 3 to a piece of a previously made intermediate blank.

The forming path defines the second feed direction 12 along which the rectangular pieces and the intermediate blank are conveyed.

To this end, there are provided joining means 32 for joining at least two rectangular pieces 3 or one rectangular piece, as well as a piece of a previously made intermediate blank, relative to respective first edges 3*a*.

The joining means 32 are arranged along the forming path 11.

According to a possible embodiment, the joining means 32 comprises a gun 33 suitable for providing a layer of adhesive material or glue at the first edges 3*a*. Preferably the gun 33 is mounted slidably along a direction perpendicular to the second feed direction 12. In particular, the gun 33 comprises wheels 34 sliding on a guide 35, which guide 35 is arranged perpendicularly to the second feed direction 12. Actuating means, for example a motor 36, are operatively associated to a belt 37 which is solidly constraint to the gun 33.

Figure 3:
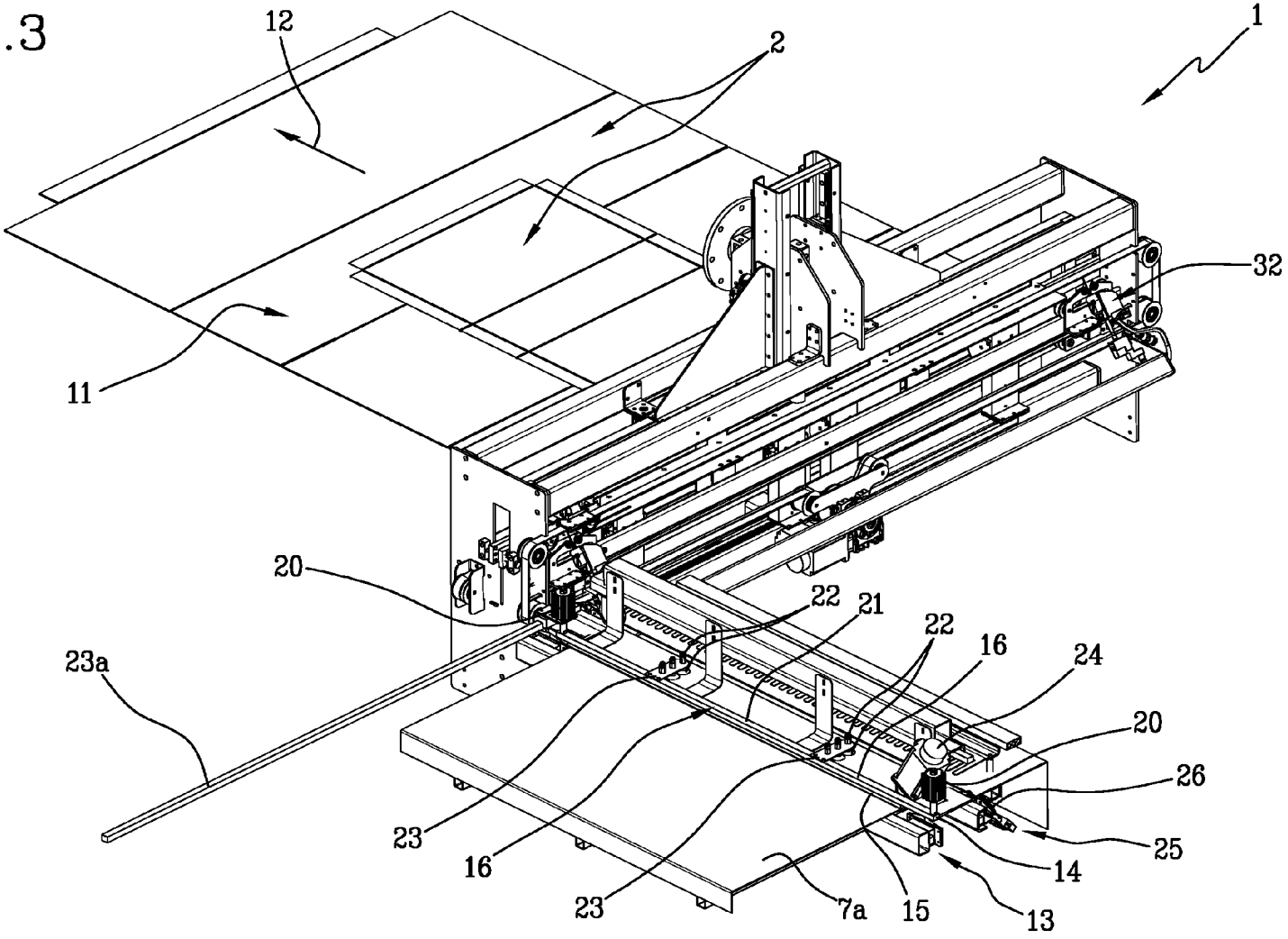
FIG. 3 is a schematic perspective view of an enlarged detail of the machine of FIG. 1, according to a different angle, in which some elements have been omitted to highlight others.
Figure 5:
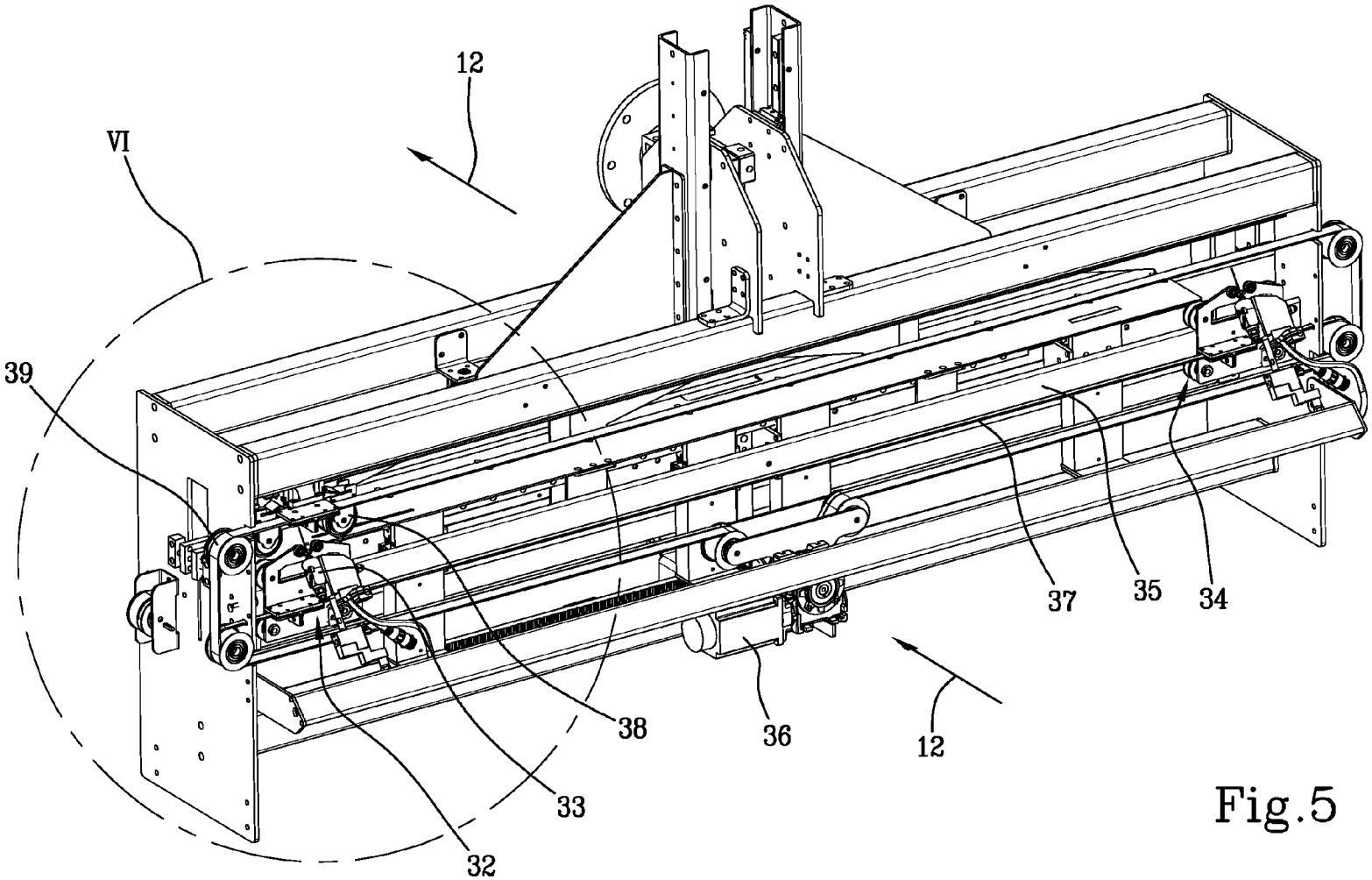
FIG. 5 is a schematic view in perspective of an enlarged detail of the machine of FIG. 1, according to a different angle, in which some elements have been omitted to highlight others.
Figure 6:
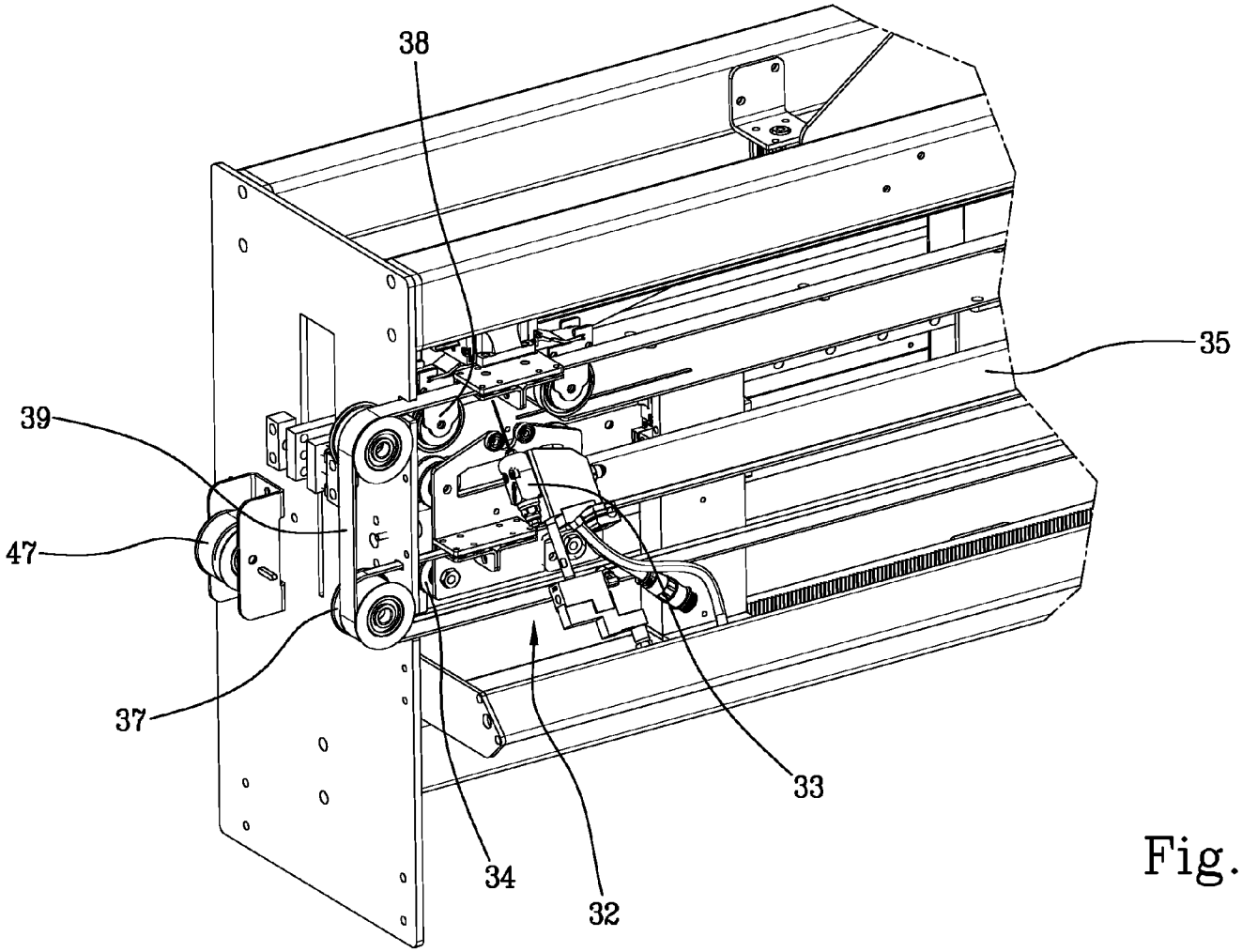
FIG. 6 is a schematic perspective view of the enlarged detail VI of the machine of FIG. 5.
Figure 7:
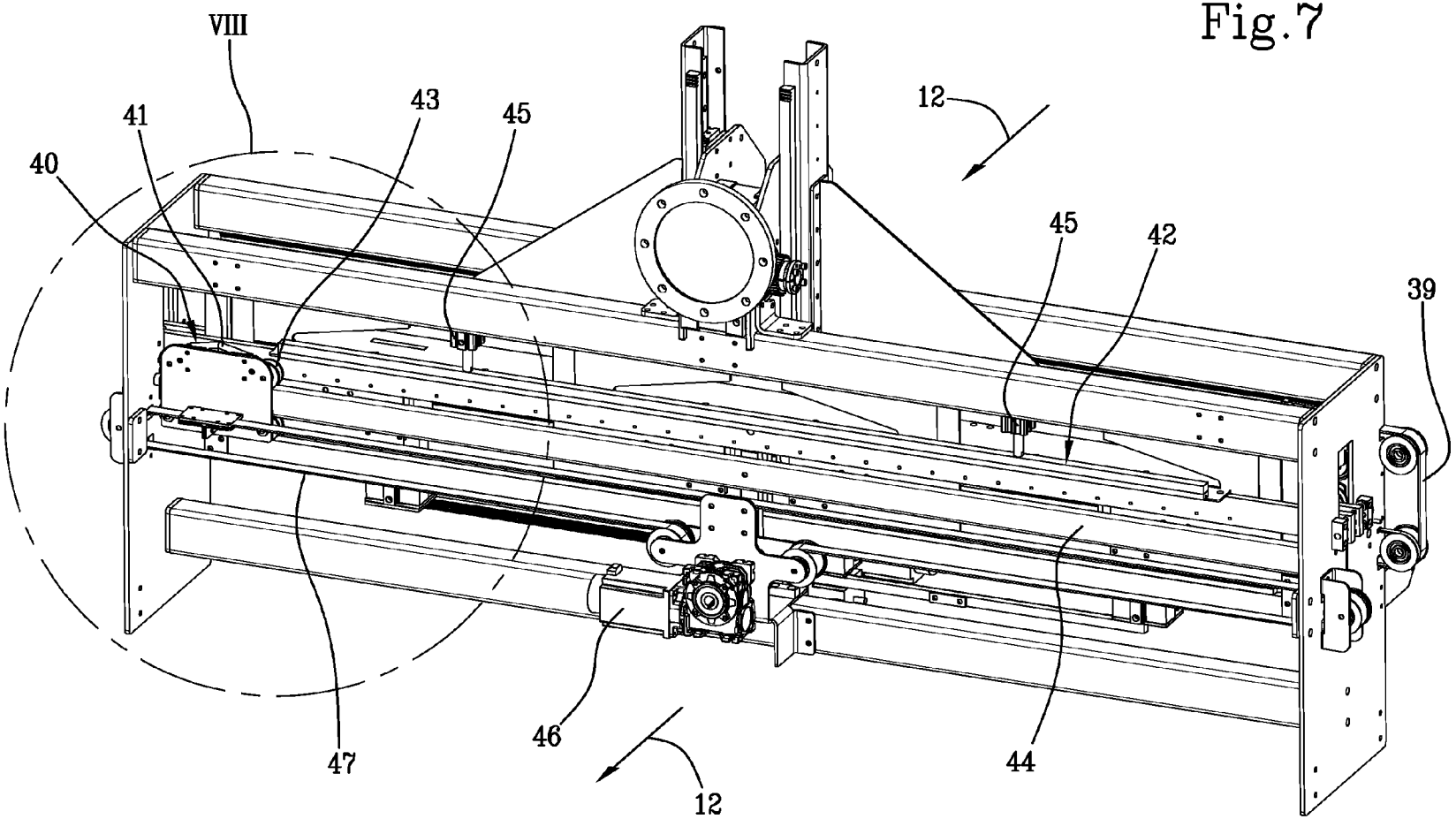
FIG. 7 is a schematic perspective view of the machine of FIG. 5, according to a different angle.
Figure 8:
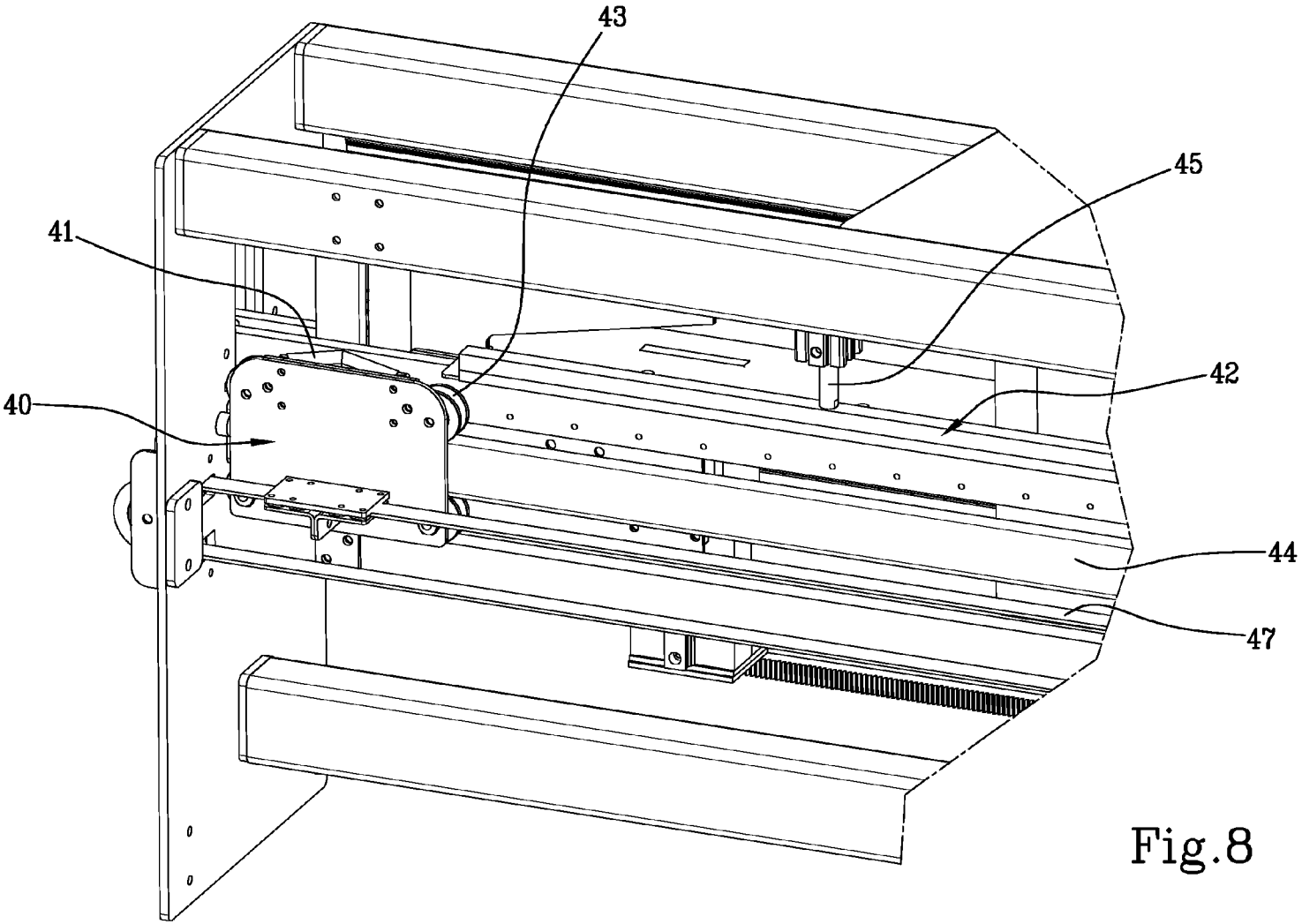
FIG. 8 is a schematic perspective view of the enlarged detail VIII of the machine of FIG. 7.

Contrasting means, for example in the form of wheels 38, are associated to the joining means 32 from the opposite side of the latter with respect to the intermediate blank. Preferably, the contrasting means are moved by the same actuating means of the joining means 32, for example by means of a further belt 39 driven by the same motor 36. In FIGS. 3 and 5, the gun 33 has been illustrated in two extreme positions.

Along the forming path 11, there is provided to cut the intermediate blank parallel to the first edges so as to obtain the blank 2 having a pre-determined width "La" and a pre-determined length "Lu".

For this purpose, there are provided cutting means 40 arranged along the forming path 11. The cutting means 40 are configured for cutting the intermediate blank parallel to the first edges thereby obtaining the blank 2 having a pre-determined width "La" and a pre-determined length "Lu".

In a possible embodiment, the cutting means 40 comprises at least one cutter 41 movable perpendicularly to the second feed direction 12.

Preferably, the cutter 41 co-operates with a matrix 42. In the non-limiting example illustrated in the figures, the cutter 41 is associated to the wheels 43 sliding on a guide 44 which is arranged perpendicularly to the second feed direction 12.

According to a possible embodiment, it is possible to associate actuators 45, for example linear actuators, to the matrix 42, so as to raise it and lower it with respect to the cutter 41. Actuating means, for example, a motor 46, are operatively associated to a belt 47 which is solidly constraint to the cutter 41.

The cut performed by the cutting means 40 can be performed prior or after the junction carried out by the joining means 32.

The invention claimed is:

1. A method for making blanks (2) for boxes to measure, comprising:

making rectangular pieces (3) of said blank (2), each rectangular piece (3) having a width ("La") measured along a first edge (3*a*) of the rectangular piece, equal to a pre-determined width ("La") of the blank (2), and a length ("lu"), measured along a second edge (3*b*) of the rectangular piece, making from said rectangular pieces (3) at least an intermediate blank having a width ("La"), equal to said pre-determined width of the blank (2) and a length greater than the length ("lu") of the rectangular pieces (3) and greater than a pre-determined length ("Lu") of the blank (2), wherein making at least an intermediate blank comprises joining, at respective first edges (3*a*), a rectangular piece (3) to another rectangular piece (3) or a rectangular piece (3) to a piece of a previously made intermediate blank, cutting said intermediate blank parallel to said first edges (3*a*) so as to obtain said blank (2) having said pre-determined width ("La") and said pre-determined length ("Lu").

2. The method for making blanks for boxes to measure according to claim 1, wherein making rectangular pieces (3) of said blank (2) comprises:

preparing a continuous sheet (5) extending along a major direction of extension (6) and having a transverse dimension ("Lt"), feeding said continuous sheet (5) along said major direction of extension (6), cutting said continuous sheet (5) perpendicularly to said major direction of extension (6) for a length equal to said pre-determined width ("La") of said blank (2).

3. The method for making blanks for boxes to measure according to claim 2, wherein making rectangular pieces (3) of said blank (2) further comprises trimming said continuous sheet (5) along said major direction of extension (6) so as to obtain a thickness that is inclined relative to a plane in which said continuous sheet (5) lies.

4. The method for making blanks for boxes to measure according to claim 1, wherein making rectangular pieces (3) of said blank (2) comprises:

preparing at least a single sheet (10) having an initial width ("la"), measured along a first edge (10*a*) of the single sheet, and an initial length ("l"), measured along a second edge (10*b*) of the single sheet, making said rectangular pieces (3) from single sheets (10) by cutting a single sheet perpendicularly to said initial width ("la") and/or joining, at respective second edges (10*b*), a single sheet to another single sheet or to pieces of single sheets so as to obtain said pre-determined width ("La") of said blank (2), if said initial width ("la") is different from said pre-determined width ("La") of said blank (2).

5. The method for making blanks for boxes to measure according to claim 4, wherein making rectangular pieces (3) of said blank (2) further comprises trimming said single sheet (10) along said initial width ("la"), so as to obtain a thickness that is inclined relative to a plane in which said single sheet (10) lies.

6. The method for making blanks for boxes to measure according to claim 1, comprising:

making said rectangular pieces (3) of said blank (2) by conveying a continuous sheet (5) or single sheets (10) along a first feed direction (8) parallel to said major direction of extension (6) or to said initial width ("la"), making said intermediate blank and cutting said intermediate blank by conveying said rectangular pieces and said intermediate blank along a second feed direction (12) perpendicular to the first feed direction (8).

7. A machine (1) for making blanks (2) for boxes to measure, comprising:

feed means configured to make rectangular pieces (3) of said blank (2), each rectangular piece (3) having a width ("La"), measured along a first edge (3*a*) of the rectangular piece, equal to a pre-determined width ("La") of the blank (2) and a length ("lu") measured along a second edge (3*b*) of the rectangular piece, joining means (32) for joining at least two rectangular pieces (3) or one rectangular piece (3) and a piece of a previously made intermediate blank at respective first edges (3*a*) so as to obtain an intermediate blank having a width ("La") equal to said pre-determined width ("La") of the blank (2) and a length greater than said a pre-determined length ("Lu") of the blank (2), cutting means (40) to cut said intermediate blank parallel to said first edges so as to obtain said blank (2) having said pre-determined width ("La") and said pre-determined length ("Lu").

8. The machine for making blanks for boxes to measure according to claim 7, wherein said feed means for making rectangular pieces (3) of said blank (2) comprises:

an automatic store (4) configured to receive a continuous sheet (5) extending along a major direction of extension (6) and having a transverse dimension ("Lt"), a feed path (7) configured for planar feeding of said continuous sheet (5) along said major direction of extension (6) corresponding to a first feed direction (8).

9. The machine for making blanks for boxes to measure according to claim 7, wherein said feed means for making rectangular pieces (3) of said blank (2) comprises:

an automatic store (9) of single sheets (10), each having an initial width ("la"), measured along a first edge (10*a*) of the single sheet, and an initial length ("l"), measured along a second edge (10*b*) of the single sheet, a feed path (7) configured for planar feeding of said single sheets (10) along a first feed direction (8) parallel to said initial width ("la").

10. The machine for making blanks for boxes to measure according to claim 8, comprising preliminary cutting means (13) configured to cut said continuous sheet (5) perpendicularly to said major direction of extension (6) for a length equal to said pre-determined width ("La") of said blank (2) and/or to cut a single sheet (10) perpendicularly to said initial width ("la").

11. The machine for making blanks for boxes to measure according to claim 10, wherein said preliminary cutting means (13) comprises at least a cutter (14), movable perpendicularly to said first feed direction (8) along a slit (15) in a supporting surface (7*a*) for said continuous sheet (5) and/or said single sheet (10) and cooperating with a matrix (16) positioned on the side opposite the supporting surface (7*a*).

12. The machine for making blanks for boxes to measure according to claim 8, comprising a trimming device (24) configured to trim said continuous sheet (5) and/or said single sheet (10) along said first feed direction (8) so as to obtain a thickness that is inclined relative to a plane in which said continuous sheet (5) and/or said single sheet (10) lie.

13. The machine for making blanks for boxes to measure according to claim 9, comprising preliminary joining means (25) configured to join, at respective second edges (10*b*), said single sheet (10) to another single sheet or to pieces of single sheets so as to obtain said pre-determined width ("La") of said blank (2), if said initial width ("la") is different from said pre-determined width ("La") of said blank (2).

14. The machine for making blanks for boxes to measure according to claim 8, comprising:

a forming path (11) configured for planar feeding of said rectangular pieces (3) along a second feed direction (12) perpendicular to the first feed direction (8), said joining means (32) and said cutting means (40) being disposed along said forming path (11).

15. The method of claim 1, wherein said length ("lu") measured along the second edge (3*b*) of the rectangular piece (3) is less than the pre-determined length ("Lu") of the blank (2).

16. The machine of claim 7, wherein said length ("lu") measured along the second edge (3*b*) of the rectangular piece (3) is shorter than the pre-determined length ("Lu") of the blank (2).

* * * * *